US007261233B2

(12) United States Patent
Menghini

(10) Patent No.: US 7,261,233 B2
(45) Date of Patent: Aug. 28, 2007

(54) DECORATIVE MAILBOX ACCESSORY STRUCTURE

(76) Inventor: Carol Menghini, 5940 Rives Dr., Alpharetta, GA (US) 30004

( * ) Notice: Subject to any disclaimer, the term of this patent is extended or adjusted under 35 U.S.C. 154(b) by 122 days.

(21) Appl. No.: 11/096,867

(22) Filed: Apr. 1, 2005

(65) Prior Publication Data

US 2005/0218204 A1 Oct. 6, 2005

Related U.S. Application Data

(60) Provisional application No. 60/558,980, filed on Apr. 2, 2004.

(51) Int. Cl.
*A47G 29/12* (2006.01)

(52) U.S. Cl. ..... 232/38; 40/606.06; 40/566

(58) Field of Classification Search ..... 232/38, 232/17; 40/606.06, 566; D99/30–32; 150/154; 52/3

See application file for complete search history.

(56) References Cited

U.S. PATENT DOCUMENTS 1,495,741 A * 5/1924 Higdon, Jr. ..... 40/606.06
5,984,172 A * 11/1999 Easterwood ..... 232/38
6,296,180 B1 * 10/2001 Blizzard ..... 232/38
6,308,884 B1 * 10/2001 Hamburger ..... 232/38
6,962,284 B1 * 11/2005 Hartelius et al. ..... 232/38

* cited by examiner

*Primary Examiner*—William L. Miller
(74) *Attorney, Agent, or Firm*—Meyers & Kaplan, LLC; Barry Kaplan, Esq.; George Bonanto, Esq.

(57) ABSTRACT

A mailbox accessory structure used to decorate a freestanding mailbox is made of left and right surfaces with substantially connected front and back sides forming a top opening and is connected to the mailbox at the front end of a horizontal beam of the mailbox post and near the top end of the vertical beam of the mailbox post and permits decorative objects to be displayed around the box. The two surfaces permit the display of indicia such as holiday images, logos, and initials.

19 Claims, 3 Drawing Sheets

DECORATIVE MAILBOX ACCESSORY STRUCTURE

CROSS-REFERENCE

This patent application claims the benefit of U.S. Provisional Application No. 60/558,980 filed, Apr. 2, 2004.

BACKGROUND (1) Field of the Invention

The present invention is related to mailbox accessories, and more particularly, to a mailbox accessory for decorating a mailbox.

(2) Description of the Background

Mailboxes are the common mechanism used by homeowners to receive mail. Generally they consist of the mailbox itself attached to a mailbox post. Together they are produced in many standard shapes and sizes that conform to postal office regulations. Mailboxes usually stand at the forefront of a home, accessible to the deliverer of mail but also visible to passersby. Mailboxes are thus a prominent extension of the personality of the home and homeowner and present a decorative opportunity to the homeowner.

Some patents have been issued in the art of mailbox decoration:

U.S. Pat. No. 5,984,172, entitled "Freestanding Mailbox Cover", issued to Rodney T. Easterwood on Nov. 16, 1999, discloses an ornamental and protective cover for a freestanding mailbox which includes a sheet presenting a pair of opposed sides, a front panel presenting a passage for mail to be inserted into the mailbox, and a rear panel, the front and rear panels being connected to and interconnecting the sides. The sides and front and rear panels preferably extend downwardly a common length to their respective bottom margins to enclose a region therein. The cover may be provided with decorative and informative indicia. Moreover, the cover, which is preferably of flexible synthetic resin material, may be opaque, transparent or translucent, with cut out openings and windows of transparent material provided over the openings. A light fixture or audio source may be provided within the enclosed region. The cover may be retained in position over the freestanding mailbox by weights attached adjacent the bottom margin or the use of a drawstring to pull the bottom margin of the sides of the cover together.

U.S. Pat. No. 5,000,379, entitled "Mail Box Cover", issued to Benjamin R. LaRue on Mar. 19, 1991, discloses a rectangular paper or plastic film sheet that has a pressure sensitive backing for sticking onto the curved top and sides of a regulation mailbox. The front face is imprinted with decorative graphics arranged to be seen from both sides. Below each graphic is imprinted an elongate address bar for receiving stick-on letters and numbers supplied in a color contrasting with the address bar for enhanced visibility. Partially cut through portions of the cover may be torn away to admit the indicating flag. The system is adapted for application without tools or special skills and enough letters and numbers are provided for identification of the mailbox as recommended by postal authorities.

U.S. Pat. No. 4,813,595, entitled "Mailbox for Receiving Decorative Overlays", issued to Benjamin I. Johns, et. al., on Mar. 21, 1989, discloses a mailbox which comprises a housing having flanges located at the bottom, outside periphery thereof and defining holding grooves for peripheral edges of a decorative overlay. Sides of the housing have holes therein which align with corresponding holes of the decorative overlay when the peripheral edges are inserted into the grooves. The decorative overlay is attached to the mailbox by inserting removable fasteners into the aligned holes, thus allowing the overlay to be readily attached to and removed from the housing.

U.S. Pat. No. 6,296,180, entitled "Postal Box Covering", issued to Clarence E. Blizzard on Oct. 2, 2001, discloses a postal box covering for protecting a postal box from the elements of weather. The postal box covering includes a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

U.S. Pat. No. 6,308,884, entitled "Device and Method for Suspending a Flag Display from a Mailbox", issued to Robert Hamburger, on Oct. 30, 2001, discloses a system and method of attaching a flag display to a mailbox in a manner that enables the flag display to hang below the mailbox. The system includes a flag display that has a length equivalent to the sum of the combined lengths of the two sides of the mailbox and the front of the mailbox. The top edge of the flag display attaches to the exterior of the mailbox, near its base. The flag display attaches to the mailbox using hook and loop material or some other equivalent fastening means. The flag display hangs down from the base of the mailbox while maintaining the generally rectangular configuration of the mailbox base. At the bottom of the flag display, the flag display is either weighted or anchored to the mailbox post.

U.S. Pat. No. 1,495,741, entitled "Advertising Mail-box Support", issued to Elijah L. Higdon, Jr., on May 27, 1924, discloses an advertising frame support for rural mail boxes which can be cheaply constructed; which will afford a firm and satisfactory mounting for the mail box; and which comprises a frame work preferably formed of light structural iron and containing an advertising panel adapted to form a brace for the light frame which is disposed at right angles to the road to display both sides of the panel to the road.

While these patents teach the concept of covers with decoration for mailboxes, they do not teach a housing mechanism for placing decorative objects within the cover structure so that decorative objects are visibly displayed.

Thus there remains a need for an invention that decorates a mailbox while providing a housing mechanism for visibly displaying decorative objects. The invention should be inexpensive and easy for the mailbox owner to assemble. The present invention addresses these needs by enclosing the mailbox with a structure having an opening in which to place decorative objects.

SUMMARY OF THE INVENTION

The present invention is directed to a decorative mailbox accessory structure comprised of a right surface and a left surface with front and back sides of each surface substantially connected together such as to substantially enclose a mailbox while permitting objects to be placed within the structure.

One embodiment of the invention is directed to a mailbox accessory structure made of a durable, flexible, stretchable material such as woven fabric, canvas, nylon, plastic, polyester, or vinyl.

Another embodiment of the present invention is directed to a mailbox accessory structure made of weather resistant material.

Another embodiment of the invention is directed to a mailbox accessory structure that connects to the mailbox at the front end of the horizontal beam of the mailbox post and near the top end of the vertical beam of the mailbox post through an attachment device such as a tab and hook mechanism.

Another embodiment of the invention is directed to a mailbox accessory structure that is connected to the ground through a ground connecting mechanism.

Another embodiment of the invention is directed to a mailbox accessory structure that carries and displays indicia thereon.

Other embodiments and advantages of the invention are set forth in part in the following description and, in part, will be obvious from this description, or may be learned from the practice of the invention.

BRIEF DESCRIPTION OF DRAWINGS

For a fuller understanding of the nature of the present invention, reference should be had to the following detailed description taken in connection with the accompanying drawings in which.

DETAILED DESCRIPTION OF THE INVENTION

Figure 1:
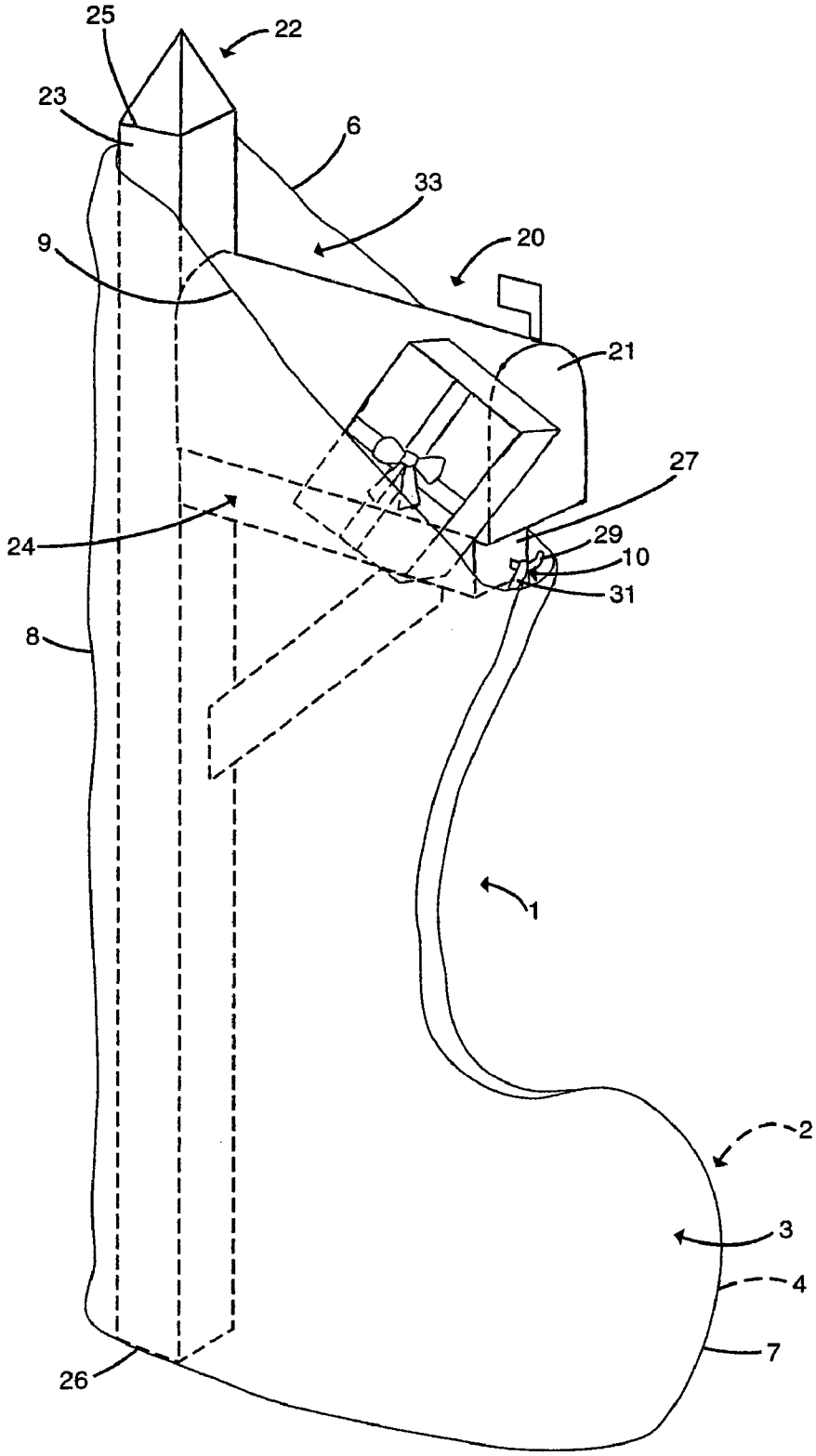
FIG. 1 is a front perspective view of a preferred embodiment of the mailbox accessory structure connected to a mailbox.

As shown in the accompanying drawings, the present invention relates to a mailbox accessory structure, generally indicated by reference numeral 1, designed to be used in combination with a mailbox, generally indicated by reference numeral 20, which includes box, 21, and a supporting post, 22. The supporting post is made of a vertical beam 23, and a horizontal beam, 24, said horizontal beam, 24, intersecting said vertical beam, 23. Said vertical beam has a top end, 25, and a bottom end, 26. Said horizontal beam, 24, has front end, 27, and back end, 28. The box, 21, rests upon the horizontal beam, 24. Like numerals represent like parts of the invention.

Figure 2:
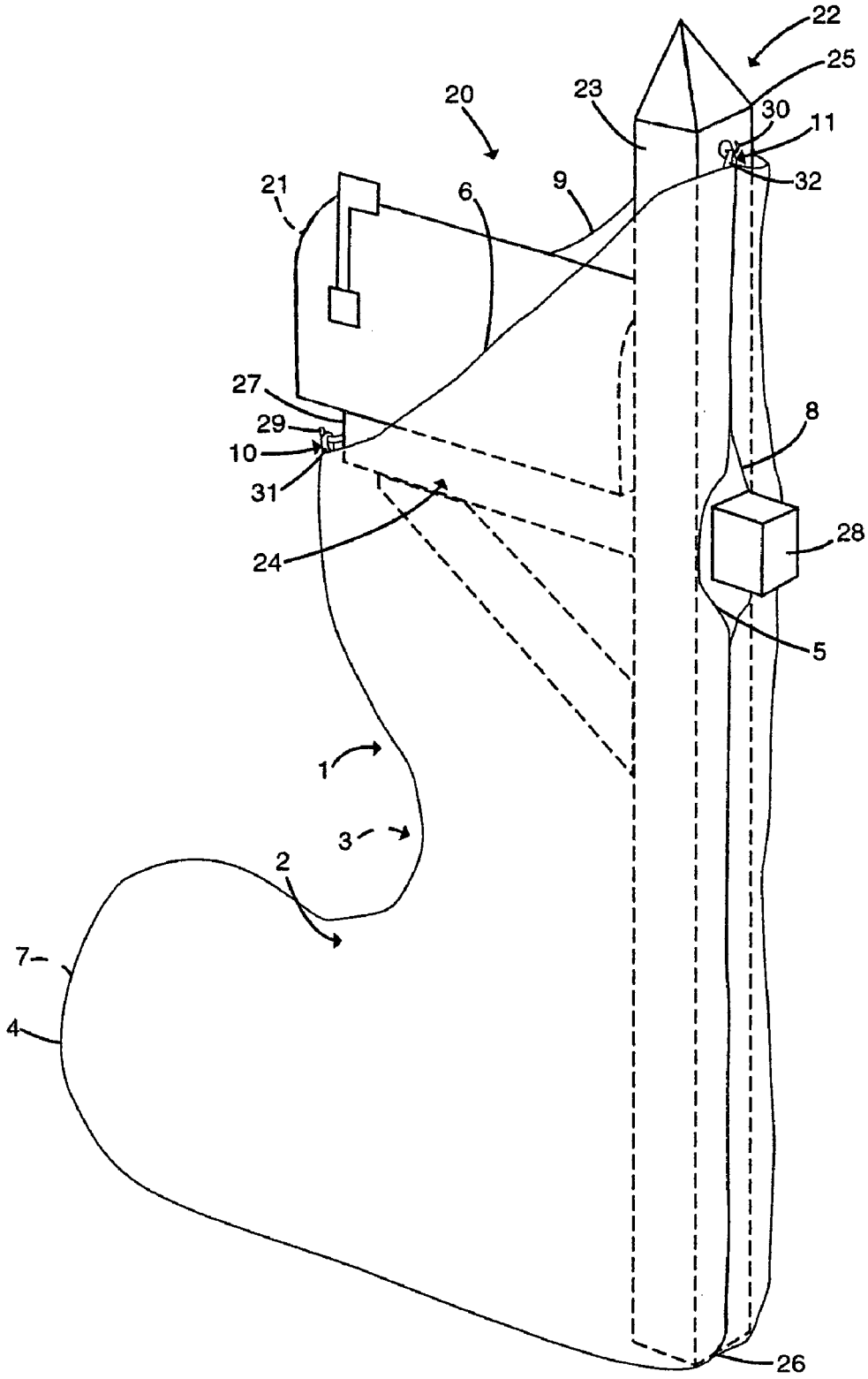
FIG. 2 is a back perspective view of a preferred embodiment of the mailbox accessory structure connected to a mailbox.

FIGS. 1 and 2 illustrate one embodiment of the present invention, a decorative mailbox accessory structure, 1. The invention provides a structure comprised of at least two opposed surfaces, a left surface, 2, and a right surface 3. As depicted in FIGS. 1 and 2, the left surface, 2, is located left of the mailbox, 20, and the right surface, 3, is located right of the mailbox, 20. The left surface, 2, and right surface, 3, both have substantially three sides. The left surface, 2, is formed by a left surface front side, 4, a left surface back side, 5, and a left surface top side 6. The right surface, 3, is formed by a right surface front side, 7, a right surface back side, 8, and a right surface top side, 9. In FIGS. 1 and 2, left surface front side, 4, and right surface front side, 7, form a shape of a holiday stocking. In other preferred embodiments, left surface front side, 4, and right surface front side, 7, can be joined together to form other shapes.

The heights of left surface front side, 4, and right surface front side 7, are about the height measured from the ground to under the box, 21. The left surface top side, 6, and right surface top side, 9, are about between twenty-four and thirty-six inches in length. The left surface back side, 5, and the right surface back side, 8, are about the height of the associated supporting post, 22. The mailbox accessory structure, 1, will substantially enclose the mailbox, 20, leaving an opening, 33, in the structure allowing for the housing of objects. The box, 21, remains visible to passersby and accessible to mailpersons.

Preferably, the invention is made of a durable, flexible, or stretchable material such as woven fabric, canvas, nylon, plastic, polyester or vinyl. In another preferred embodiment, the material is weather resistant. In one preferred embodiment the material is opaque. In another preferred embodiment the material is translucent.

In a preferred embodiment of the present invention, left surface, 2, and right surface, 3, are connected to each other. Left surface front side, 4, is connected to right surface front side, 7. They may be connected by any commonly used mechanism to connect two surfaces of the type of material used for the invention. For example if the material is cloth, they may be sewn together. In another preferred embodiment, left surface front side, 4, is unitary with right surface front side, 7. This means they are seamlessly connected.

Left surface back side, 5, is releasably connected to right surface back side, 8. The releasable connection is effected by using any one of a variety of commonly used attachment devices such as VELCRO, buttons, laces, strings, rope and zippers.

Figures 3A, 3B:
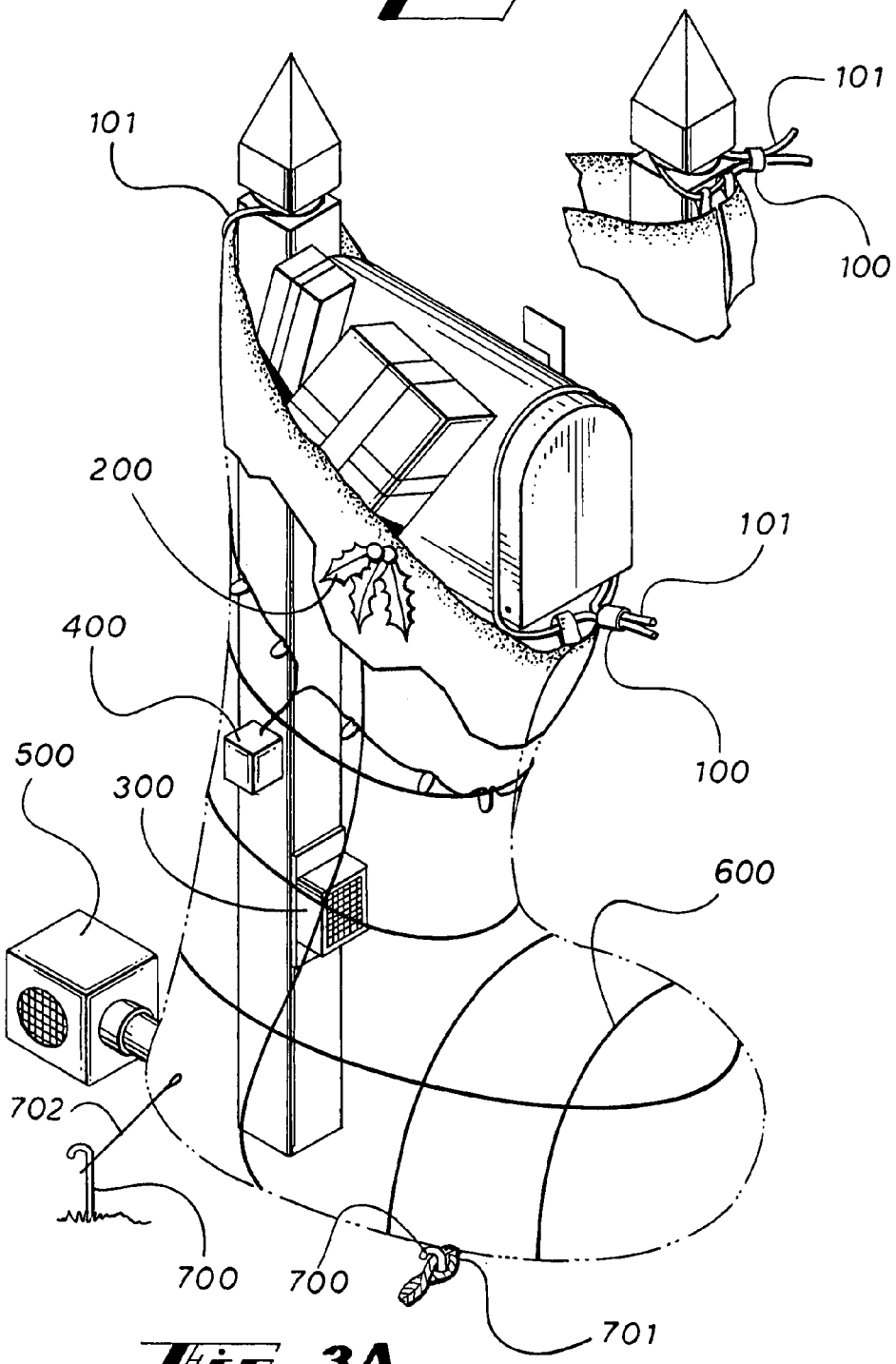
FIG. 3A is a partial cut-away front perspective view of a preferred embodiment of the mailbox accessory structure connected to a mailbox.
FIG. 3B is a back perspective detail view of a connecting device of the present invention.

As shown in FIG. 1, a front end connecting device, 10, releasably connects the mailbox accessory structure to the front end, 27, of the horizontal beam, 24. A back side connecting device, 11, releasably connects the mailbox accessory structure near the top end, 25, of the vertical beam, 23. Front end connecting device, 10, and back end connecting device, 11, include commonly used attachment mechanisms such as tab and hook devices. By example, in FIGS. 1 and 2, a first hook, 29, is placed at the front end, 27, of the horizontal beam, 24. A second hook, 30, is placed near the top end, 25, of the vertical beam, 23. A first tab, 31, is connected to the mailbox accessory structure, 1, and loops over the first hook, 29. A second tab, 32, is connected to the mailbox structure, 1, In another preferred embodiment shown in FIG. 3A, a common cord, 101, and lock device, 100, is used to join the mailbox structure, 1, to the mailbox, 20, by looping a cord through the first tab, 31, and circling it around the box, 21.

In one preferred embodiment the invention carries and displays indicia 200. Indicia means messages, such as but not limited to familiar holiday symbols, logos, initials and the like. The indicia can be stitched, painted, printed onto, or cut out from, the left surface, 2, and the right surface, 3, of the invention.

Another embodiment of the invention is directed to a mailbox accessory structure that is connected to the ground through a ground connecting mechanism. The ground connecting mechanism is one of many common methods for connecting above ground structure to the ground. Such mechanisms include stakes, 700, guy-wires, 702, cords, tabs 701, or the like. In one embodiment, the mailbox accessory structure, 1, is staked to the ground. In another embodiment the mailbox accessory structure, 1, is wired to the ground. In another embodiment the mailbox accessory structure, 1, is roped to the ground.

In another preferred embodiment the mailbox accessory structure, 1, is given shape by an inflatable mechanism 500. In another preferred embodiment the mailbox accessory structure, 1, is given shape by a wire framework 600. The wire framework is placed inside the structure and generally internally supports and shapes the structure. In another preferred embodiment a light creation mechanism 400 is placed inside the mailbox accessory structure, 1. The light creation mechanism when placed within the structure adds to the decorative visual appeal of the mailbox accessory structure, 1, especially in darkness. In a preferred embodiment, the light creation mechanism is a light bulb. In another preferred embodiment an audio mechanism 300 is placed inside the mailbox accessory structure, 1. In this preferred embodiment sounds such as holiday music emanate from inside the structure, 1. In this preferred embodiment the sounds are created by a music player such as a tape player or a CD, MP3 player.

The mailbox accessory structure, 1, is assembled by placing the first hook, 29, at the front end, 27, of the horizontal beam, 24, placing the second hook, 30, near the top end, 25, of the vertical beam, 23, connecting the first tab, 31, to the mailbox accessory structure, 1, by looping it over the first hook, 29, joining the left surface back side, 5, and the right surface back side, 8, by an attachment mechanism, and connecting the second tab, 32, to the mailbox structure, 1, by looping it over the second hook, 30.

The basic mailbox accessory structure will now be described further by use of the following example that should not be construed as limiting the scope of this invention.

EXAMPLE

A mailbox accessory structure is provided having two surfaces each having substantially three sides to form a stocking-like structure. The structure is made of fabric such as faux fur. The back sides of the two surfaces connect using VELCRO. The front sides of the two surfaces are sewn together. The structure is joined to the front and back ends of the mailbox using a hook and tab mechanism. Once connected, the structure encloses the mailbox yet permits the mailbox to be opened and closed. It also allows for housing of decorative objects on the inside and decorative display on the outside.

Other embodiments and uses of the invention will be apparent to those skilled in the art from consideration of the specification and practice of the invention disclosed herein. All references cited herein are specifically and entirely hereby incorporated by reference. It is intended that the specification and examples be considered exemplary only. All modifications and improvements have been deleted herein for the sake of conciseness and readability but are properly within the scope of this provisional patent application.

I claim:

1. A structure for an associated free standing mailbox, the mailbox having a box and a post, the post having a vertical beam intersecting a horizontal beam, said vertical beam having a top end and a bottom end, and said horizontal beam, having a front end and a back end, said box lying lengthwise upon the horizontal beam, said structure comprising:

a) a left surface comprising at least three including
   1) a left surface front side,
   2) a left surface back side, and
   3) a left surface top side, b) a right surface comprising at least three sides including
   1) a right surface front side,
   2) a right surface back side, and
   3) a right surface top side, c) said left surface front side substantially connected to said right surface front side and said left surface back side releasably connected to said right surface back side, d) said structure connected to the front end of the horizontal beam by a first connecting device and connected near the top end of the vertical beam by a second connecting device.

2. The structure according to claim 1 wherein the structure is composed of a flexible material.

3. The structure according to claim 2 wherein said flexible material is weather resistant.

4. The structure according to claim 2 wherein said flexible material is selected from the group consisting of fabric, canvas, nylon, plastic, polyester and vinyl.

5. The structure according to claim 2 wherein the material is opaque.

6. The structure according to claim 2 wherein the material is translucent.

7. The structure according to claim 1 wherein said first connecting device comprises a first tab connected to the structure and a first hook connected to the front end of the horizontal beam, said first tab looping onto the first hook, and said second connecting device comprises a second tab connected to the structure and a second hook connected near the top end of the vertical beam, said second tab looping onto the second hook.

8. The structure according to claim 1 wherein each of said first and said second connecting devices is a cord and lock mechanism.

9. The structure according to claim 1 having indicia.

10. The structure according to claim 1 in combination with an audio mechanism placed within the structure to create sounds to emanate from within the structure.

11. The structure according to claim 1 in combination with a light creation mechanism placed within the structure to create light emanating from within the structure.

12. The structure according to claim 1 in combination with an inflatable device placed within the structure to give the structure shape and support.

13. The structure according to claim 1 in combination with a wire framework placed within the structure to give the structure shape and support.

14. The structure according to claim 1 wherein the structure is connected to the ground by a grounding mechanism.

15. The structure according to claim 14, wherein the grounding mechanism is a stake.

16. The structure according to claim 14, wherein the grounding mechanism is a wire.

17. The structure according to claim 14, wherein the grounding mechanism is a rope.

18. A decorative mailbox structure for an associated free standing mailbox, the mailbox having a box and a post, the post having a vertical beam intersecting a horizontal beam, said vertical beam having a top end and a bottom end, and said horizontal beam, having a front end and a back end, said box lying lengthwise upon the horizontal beam, said structure comprising:

a) a left surface comprising at least three sides including
   1) a left surface front side,
   2) a left surface back side, and
   3) a left surface top side, b) a right surface comprising at least three sides including
   1) a right surface front side,
   2) a right surface back side, and
   3) a right surface top side, c) said left surface front side substantially unitary with said right surface front side and said left surface back side releasably connected to said right surface back side, d) said structure connected to the front end of the horizontal beam by a first connecting device and connected near the top end of the vertical beam by a second connecting device.

19. The structure according to claim 18 wherein said first connecting device comprises a first tab connected to the structure and a first hook connected to the front end of the horizontal beam, said first tab looping onto the first hook, and said second connecting device comprises a second tab connected to the structure and a second hook connected near the top end of the vertical beam, said second tab looping onto the second hook.

* * * * *